US008562032B1

(12) United States Patent
Lin

(10) Patent No.: US 8,562,032 B1
(45) Date of Patent: Oct. 22, 2013

(54) LATCH ASSEMBLY WITH AUTOMATIC LOCKING FUNCTION

(75) Inventor: Hsi-Ting Lin, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 44 days.

(21) Appl. No.: 13/476,070

(22) Filed: May 21, 2012

(51) Int. Cl.
*E05C 9/02* (2006.01)

(52) U.S. Cl.
USPC ..... 292/166; 292/32; 292/157; 292/188; 70/108; 70/109

(58) Field of Classification Search
USPC ..... 292/157, 161, 165, 166, 188, 143, 3, 4, 292/8, 26, 30, 32–37; 70/108–111
See application file for complete search history.

(56) References Cited

U.S. PATENT DOCUMENTS

| | | | | |
|---|---|---|---|---|
| 4,362,328 | A * | 12/1982 | Tacheny et al. | 292/36 |
| 6,945,571 | B2 * | 9/2005 | Lin | 292/92 |
| 6,955,378 | B2 * | 10/2005 | Schlack et al. | 292/26 |
| 7,707,862 | B2 * | 5/2010 | Walls et al. | 70/107 |
| 7,788,954 | B2 * | 9/2010 | Schumm | 70/107 |
| 8,286,917 | B2 * | 10/2012 | Erickson et al. | 244/131 |
| 2009/0019779 | A1 * | 1/2009 | Nakanishi et al. | 49/449 |

* cited by examiner

*Primary Examiner* — Kristina Fulton
*Assistant Examiner* — Thomas Neubauer
(74) *Attorney, Agent, or Firm* — Alan Kamrath; Kamrath IP Lawfirm, PA

(57) ABSTRACT

A latch assembly (10) is mounted to a follower door (275) of a double door (257). When the follower door (275) is closed while a primary door (259) of the double door (257) is closed, an actuation latch (131) of the latch assembly (10) is moved from a releasing position to a pressing position to move a latch (231) of the latch assembly (10) to a latching position engaged in a groove (37, 300) in a door frame (31) or in the ground (299). When the actuation latch (131) is moved from the releasing position to the pressing position while the follower door (275) is not in the closed position, the latch (231) is retained in an unlatching position, avoiding damage to the latch assembly (10).

5 Claims, 11 Drawing Sheets

LATCH ASSEMBLY WITH AUTOMATIC LOCKING FUNCTION

BACKGROUND OF THE INVENTION

The present invention relates to a latch assembly and, more particularly, to a latch assembly for a double door, providing an automatic locking function while closing a follower door of the double door.

A double door generally includes a primary door and a follower door pivotably mounted to two vertical beams of a door frame. A lock is mounted to the primary door and includes a handle on a side of the primary door and a first latch on an end face of the primary door. The first latch can be retracted into the primary door upon pivotal movement of the handle. Upper and lower latch assemblies are mounted to upper and lower ends of the follower door. The upper latch assembly includes an actuation latch extending beyond an end face of the follower door and a second latch normally extending beyond an upper face of the follower door. The lower latch assembly includes an actuation latch extending beyond the end face of the follower door and a third latch normally extending beyond a bottom face of the follower door. When the follower door is moving from an open position to a closed position, each of the second and third latches is moved from an extended, latching position to a retracted, unlatching position. When the follower door is in the closed position, the second latch is engaged in a groove in the door frame, and the third latch is engaged in a groove in the ground, locking the follower door. Since the first latch of the lock on the primary door is engaged with a receptacle in the follower door, the primary door can not be opened, either. Thus, the double door can be reliably locked. However, if the primary door is closed while the follower door is not completely closed (namely, the second latch is not aligned with the groove in the door frame, and the third latch is not aligned with the groove in the ground), the second and third latches can not be moved to the exact latching positions, leading to damage to the upper and lower latch assemblies. Furthermore, the first, second, and third latches may be deformed by the heat during a fire and, thus, moved to the unlatching position, leading to the risks of opening of the double door and spread of the fire.

Thus, a need exists for a latch assembly providing an automatic locking function for a double door.

BRIEF SUMMARY OF THE INVENTION

The present invention solves this need and other problems in the field of reliable locking of a double door by providing a latch assembly including a base having two sidewalls and an intermediate wall extending between the sidewalls. Each sidewall includes a movement groove and first and second engagement holes, with the movement groove located between the first engagement hole and the second engagement hole along a first axis. The intermediate wall includes a slot. The intermediate wall of the base is adapted to be mounted to an end face of a follower door of a double door. The follower door includes an interior space. The sidewalls are adapted to be received in the interior space of the follower door. The follower door is pivotable between a closed position and an open position.

A movable member is movably received between the sidewalls of the base. The movable member includes two lateral walls spaced from each other along a second axis perpendicular to the first axis. The movable member further includes a connecting portion extending between the lateral walls. Each lateral wall includes a first end and a second end spaced from the first end along the first axis. First and second sliding grooves are defined in each lateral wall, with the first sliding groove located between the second sliding groove and the connecting portion along a third axis perpendicular to the first and second axes. The movement grooves of the sidewalls of the base are aligned with the first sliding grooves of the lateral walls of the movable member.

A first pin extends through the movement grooves of the sidewalls of the base and the first sliding grooves of the lateral walls of the movable member. A second pin extends through the first engagement holes of the sidewalls of the base and the second sliding grooves of the lateral walls of the movable member. The movable member is movable between an engagement position and a disengagement position along the first axis.

A follower is pivotably connected to the movable member and includes an arm having first and second ends. The first pin extends through the first end of the arm, allowing the follower to pivot about a pivot axis defined by the first pin. An actuation member is pivotably received in the base and has first and second ends and a pivotal portion between the first and second ends of the actuation member. The second end of the actuation member faces the intermediate wall of the base. A third pin extends through the second engagement holes of the sidewalls of the base and the pivotal portion of the limiting member. The limiting member is pivotable about a pivot axis defined by the third pin.

A limiting frame is fixed between the sidewalls of the base. The limiting frame includes a first wall and a second wall spaced from the first wall along the first axis. The limiting frame further includes a connecting wall extending between the first and second walls. The first wall includes an inner face and an outer face spaced from the inner face along the first axis. A slot extends from the inner face through the outer face of the first wall. The first and second walls are fixed to the intermediate wall of the base. The second end of the actuation member extends through the slot and is received between the first and second walls.

An actuation latch is movably received in the slot of the base. The actuation latch includes a base portion having first and second ends spaced from each other along the third axis. A wedge is formed on the second end of the actuation latch and has two actuation faces. The actuation latch is movable along the third axis between a releasing position in which the wedge is located outside of the base and a pressing position in which the wedge is received in the base. The actuation latch is adapted to be actuated by an end face of a primary door of the double door. When the follower door is in the closed position and when the end face of the primary door is aligned with the end face of the follower door, the end face of the primary door presses against the actuation latch, moving the actuation latch from the releasing position to the pressing position.

A locking block is fixed to the movable member and includes a locking hole. The locking block and the movable member are jointly movable between the engagement position and the disengagement position. A spring is mounted between the locking block and the first pin to bias the locking block and the first pin away from each other along the first axis. A connecting rod includes a first end engaged in the locking hole of the locking block and a second end. A latch includes an engagement end fixed to the second end of the connecting rod. The latch further includes a locking end. The latch is movable between a latching position and an unlatching position along the first axis. The locking end of the latch in the unlatching position is adapted to be received in the follower door. The locking end of the latch in the latching position is adapted to extend out of the follower door into a groove in a door frame or a groove (300) in a ground. The double door is adapted to be pivotably mounted to the door frame.

When the follower door is in the open position, the latch is not aligned with the groove in the door frame or ground. When the follower door is in the closed position, the latch is aligned with the groove in the door frame or ground.

When the actuation latch is in the releasing position, the movable member is in the disengagement position, and the latch is in the unlatching position.

When the follower door is in the closed position and when the actuation latch moves from the releasing position to the pressing position, the first end of the actuation latch pushes the second end of the actuation member to move the second end of the follower, causing the first pin to push the locking member via the spring, moving the movable member from the disengagement position to the engagement position while pulling the spring, thereby moving the locking end of the latch to the latching position to engage with the groove in the door frame or ground.

When the actuation latch is moved from the releasing position to the pressing position while the follower door is not in the closed position, the actuation member actuates the follower member via the push pin, moving the first pin in the movement grooves of the base along the first axis and compressing the spring, retaining the movable member in the disengagement position and retaining the latch in the unlatching position, avoiding damage to the latch assembly.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
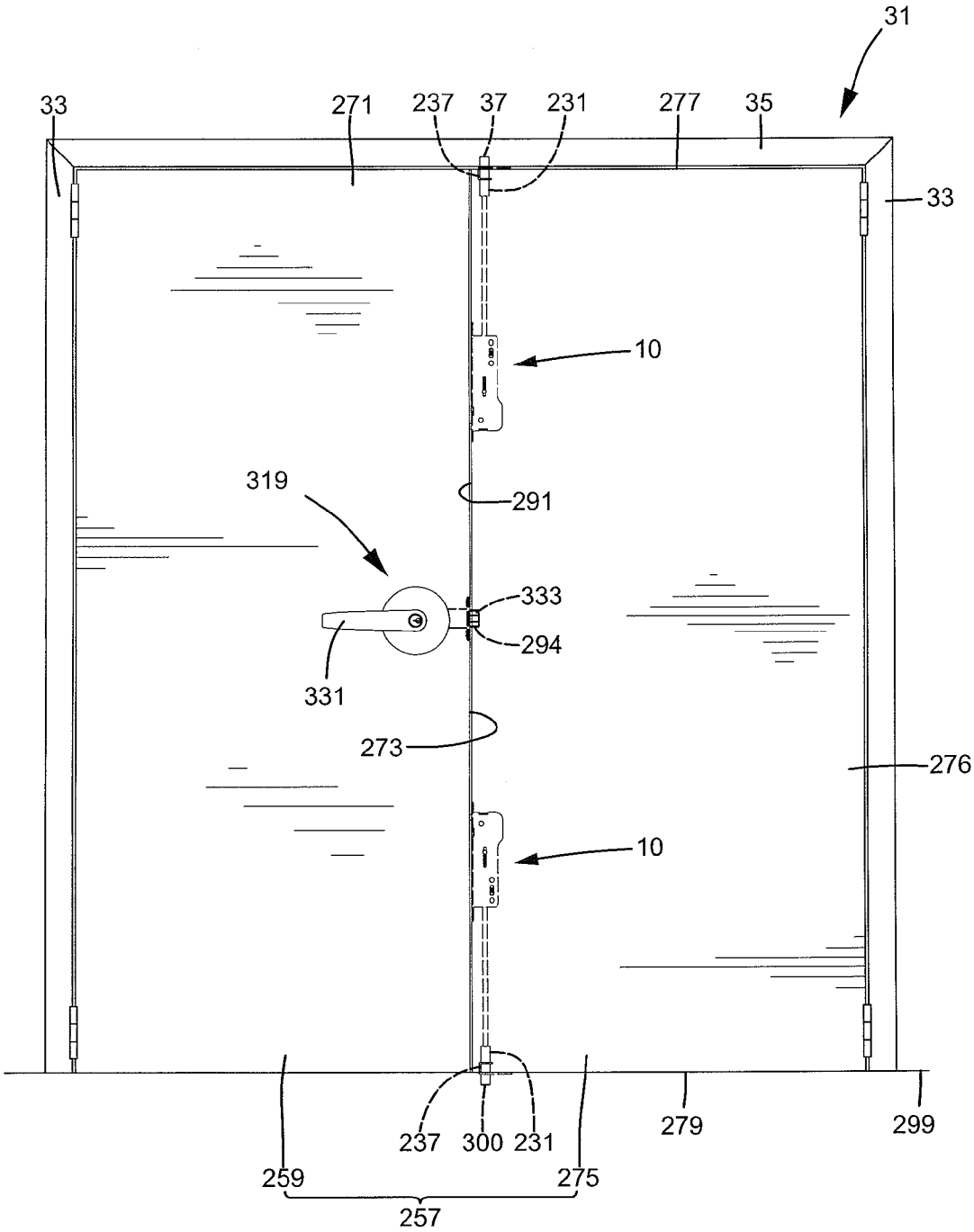
FIG. 1 shows a diagrammatic front view of a double door to which two latch assemblies according to the present invention is mounted.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "lower", "upper", "top", "bottom", "inner", "outer", "end", "portion", "section", "vertical", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

FIG. 1 shows a double door 257 mounted to a door frame 31 on a floor or ground 299. Door frame 31 includes two spaced vertical beams 33 on ground 299 and a top beam 35 extending between upper ends of vertical beams 33. Top beam 35 includes a bottom side having a groove 37. A groove 300 is defined in ground 299 and aligned with groove 37 of top beam 35.

In the form shown, double door 257 includes a primary door 259 pivotably mounted to one of vertical beams 33 and a follower door 275 pivotably mounted to the other vertical beam 33. Follower door 275 includes an interior space 293. Primary door 259 includes two sides 271 and an end face 273 extending between sides 271 and extending perpendicularly to ground 299. Follower door 275 includes two sides 276, a top face 277 extending between sides 276 and facing top beam 35, and a bottom face 279 extending between sides 276 and facing ground 299. Top face 277 includes a mounting hole 295 in communication with interior space 293. Follower door 275 further includes an end face 291 extending between sides 276 and between top and bottom faces 277 and 279. Two engagement holes 297 are defined in end face 291 of follower door 275 and spaced from each other along a first axis X perpendicular to ground 299. A receptacle 294 is defined in end face 291 and located intermediate engagement holes 297. Follower door 275 is pivotable about an axis parallel to first axis X between an open position and a closed position. When follower door 275 is in the open position, mounting holes 295 are not aligned with grooves 37 and 300. When follower door 275 is in the closed position, mounting hole 295 in top face 277 is aligned with groove 37, and mounting hole 295 in bottom face 279 is aligned with groove 300 in ground 299.

A door lock 319 is mounted to primary door 259. Door lock 319 can be of any desired form as conventional including but not limited to of a commercially available type. In the form shown, door lock 319 includes a latch 333 and a handle 331 operatively connected to latch 333. Handle 331 is located on one of sides 271 of primary door 259. Pivotal movement of handle 331 causes movement of latch 333 from an extended position outside of end face 273 of primary door 259 to a retracted position inside of primary door 259. When follower door 275 is in the closed position, end face 273 of primary door 259 is aligned with end face 291 of follower door 275, with a gap existed between end faces 273 and 291, and with latch 333 engaged in receptacle 294 of follower door 275.

Figure 4:
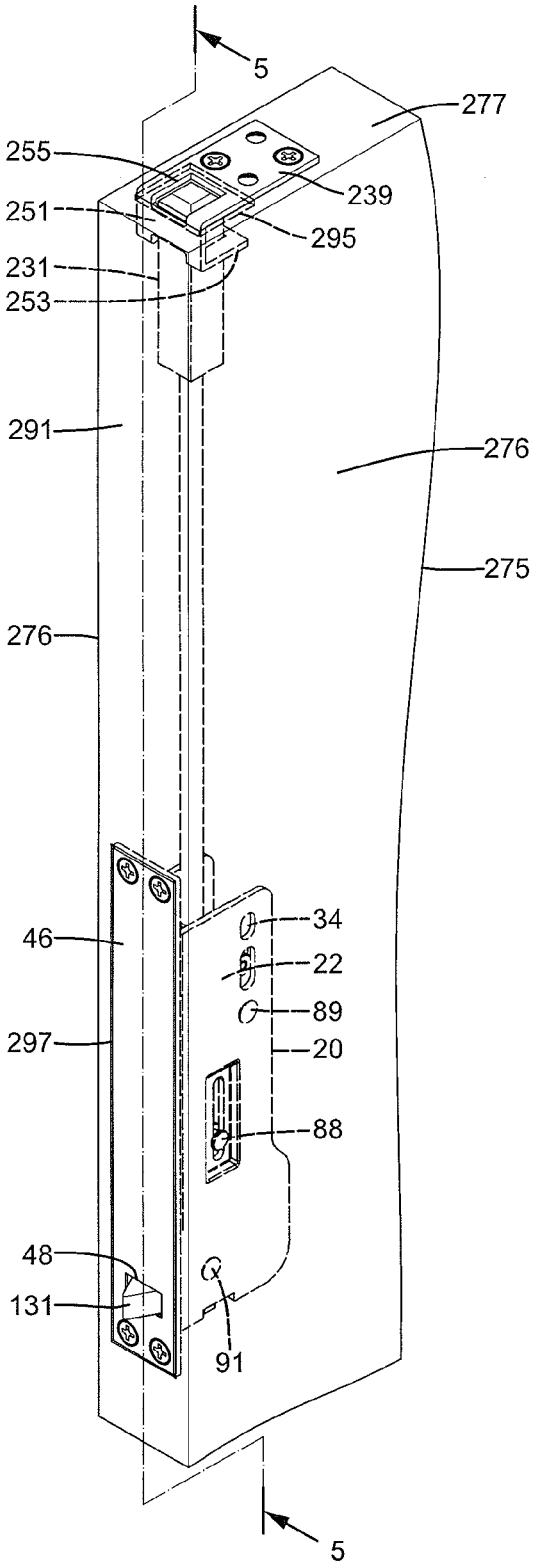
FIG. 4 shows a partial, perspective view of the double door of FIG. 1.

According to the form shown, upper and lower coupling members 237 are respectively mounted in mounting holes 295 of follower door 275 (FIG. 4). Each of upper and lower coupling members 237 includes a first portion 239, a second portion 251, and a third portion 253. Second portion 251 extends perpendicularly to an end of first portion 239 and an end of third portion 253, with first and third portions 239 and 253 parallel to and spaced from each other. A receiving hole 255 is defined in each of first and third portions 239 and 253, with receiving hole 255 of first portion 239 aligned with receiving hole 255 of third portion 253. First portion 239 of upper coupling member 237 is fixed to top face 277 of follower door 275, with second and third portions 251 and 253 of upper coupling member 237 extending through mounting hole 295 into interior space 293 of follower door 275. First portion 239 of lower coupling member 237 is fixed to bottom face 279 of follower door 275, with second and third portions 251 and 253 of lower coupling member 237 extending through mounting hole 295 into interior space 293 of follower door 275.

Figure 2:
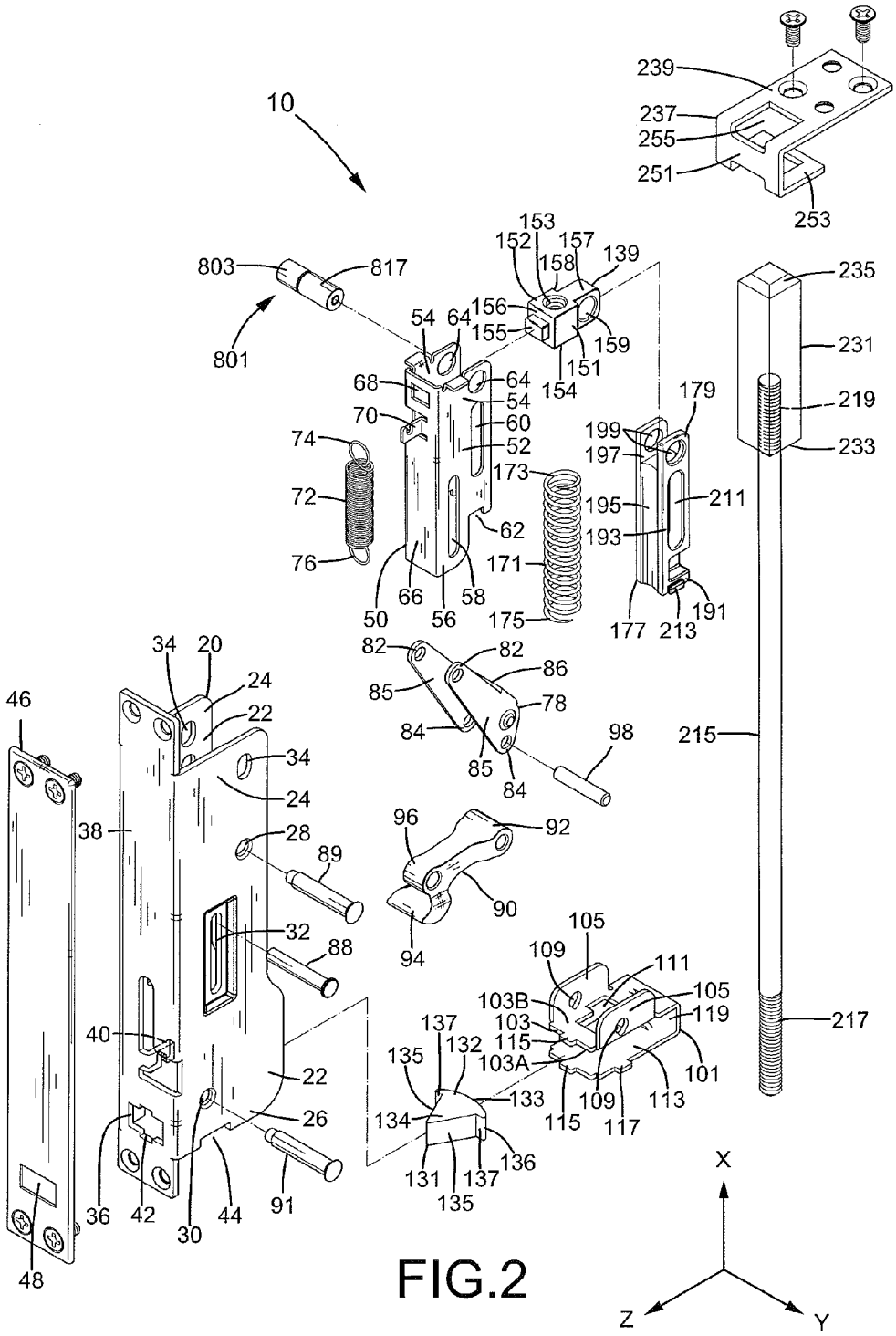
FIG. 2 shows an exploded, perspective view of one of the latch assemblies of FIG. 1.

In the form shown, latch assemblies 10 are mounted in locations respectively adjacent to top and bottom faces 277 and 279 of follower door 275 and arranged in a symmetric manner relative to a horizontal plane that is perpendicular to first axis X, with receptacle 294 and latch 333 located in the horizontal plane. Each latch assembly 10 includes a base 20 (FIG. 2) having two sidewalls 22 spaced along a second axis Y perpendicular to first axis X and an intermediate wall 38 extending between sidewalls 22. Each sidewall 22 includes a first end 24 and a second end 26 spaced from first end 24 along first axis X. Each sidewall 22 further includes a movement groove 32 located between first and second ends 24 and 26, a first engagement hole 28 located between first end 24 and movement groove 32, and a second engagement hole 30 located in second end 26. Each sidewall 22 further includes a coupling hole 34 located in first end 24. A slot 36 is defined in intermediate wall 38 and adjacent to second end 26 of each sidewall 22. Slot 36 includes two edges spaced along first axis X, with a first engagement groove 42 defined in each edge of first slot 36. Each sidewall 22 further includes a second engagement groove 44 in second end 26. A hooked portion 40 is formed on intermediate wall 38 and located between movement groove 32 and slot 36 along first axis X and located in a space defined by sidewalls 22 and intermediate wall 38.

In the form shown, a faceplate 46 is mounted to intermediate wall 38 and includes an opening 48 aligned with slot 36. Screws are extended through faceplate 46 and intermediate wall 38 into end face 291 of follower door 275. Intermediate wall 38 of base 20 and faceplate 46 of each latch assembly 10 are engaged in one of engagement holes 297 of follower door 275 (FIGS. 4 and 5), with sidewalls 22 received in interior space 293 of follower door 275, with first end 24 of each sidewall 22 of an upper one of latch assemblies 10 facing top beam 35, and with first end 24 of each sidewall 22 of a lower one of latch assemblies 10 facing ground 299 (FIG. 1).

According to the form shown, each latch assembly 10 further includes a movable member 50 movably received between sidewalls 22 of base 20. Movable member 50 includes two lateral walls 52 spaced from each other along second axis Y and a connecting portion 66 extending between lateral walls 52. Each lateral wall 52 includes a first end 54 and a second end 56 spaced from first end 54 along first axis X. Each lateral wall 52 further includes a first sliding groove 58 adjacent to second end 56 and a second sliding groove 60 adjacent to first end 54, with first sliding groove 58 located between second sliding groove 60 and connecting portion 66 along a third axis Z perpendicular to first and second axes X and Y. Each lateral wall 52 further includes a mounting hole 64 in first end 54 and an engagement notch 62 in second end 56. Connecting portion 66 includes a lug 70 adjacent to first end 54 of each lateral wall 52 and an engagement slot 68, with lug 70 located between second end 56 of lateral wall 52 and engagement slot 68. Lateral walls 52 of movable member 50 are received between sidewalls 22 of base 20, with first sliding grooves 58 of lateral walls 52 aligned with movement grooves 32 of sidewalls 22, with first engagement holes 28 of sidewalls 22 aligned with second sliding grooves 60 of lateral walls 52, with connecting portion 66 facing intermediate wall 38, and with lug 70 spaced from hooked portion 40 along first axis X.

Figure 8:
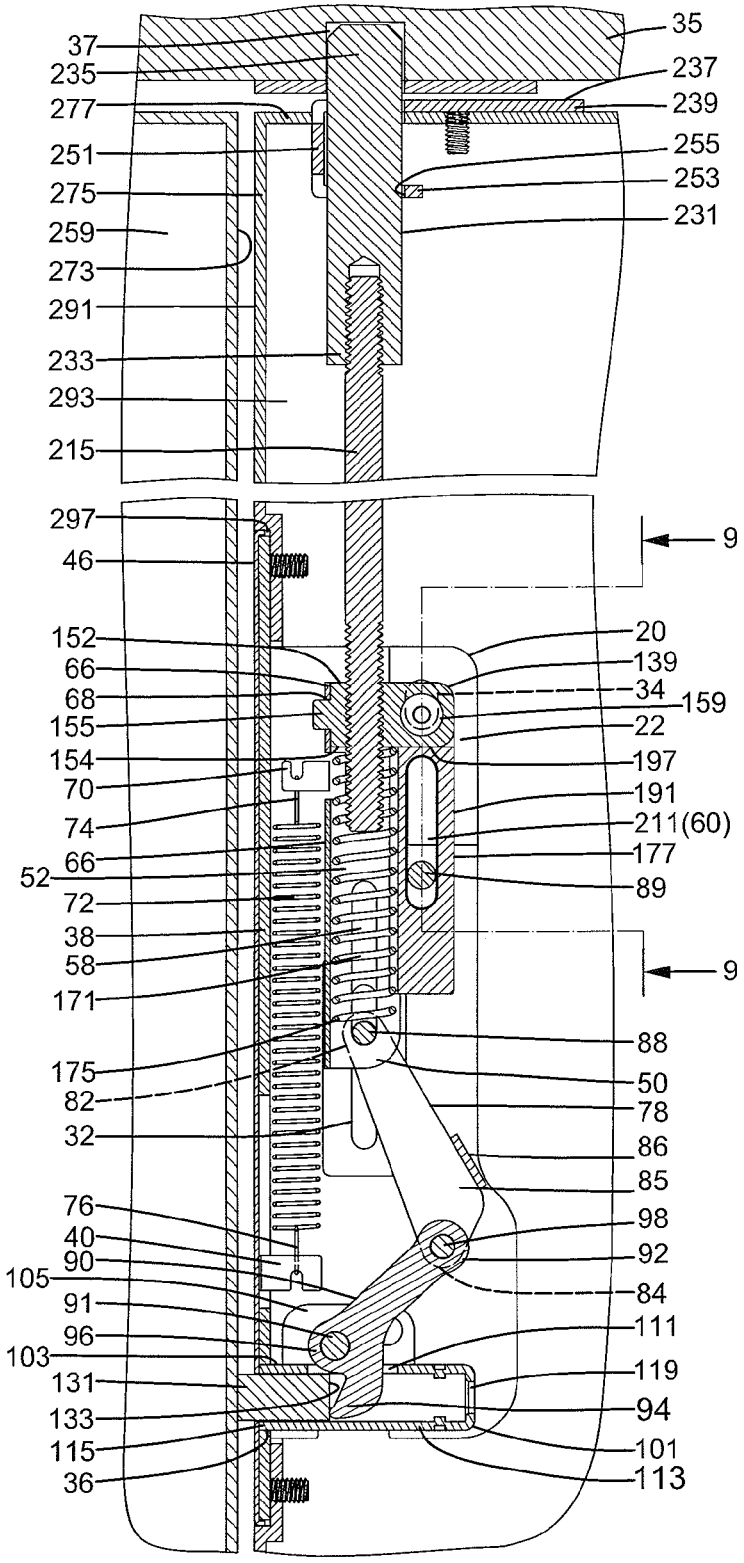
FIG. 8 shows a view similar to FIG. 5, with a primary door closed, and with a latch engaged in a groove in a door frame for the double door.

In the form shown, each latch assembly 10 further includes a first pin 88 extending through movement grooves 32 of sidewalls 22 of base 20 and first sliding grooves 58 of lateral walls 52 of movable member 50. Each latch assembly 10 further includes a second pin 89 extends through first engagement holes 28 of sidewalls 22 of base 20 and second sliding grooves 60 of lateral walls 52 of movable member 50. Thus, movable member 50 is movable along first axis X between a disengagement position (FIG. 5) and an engagement position (FIG. 8). A spacing between lug 70 of movable member 50 in the disengagement position and hooked portion 40 of base 20 is smaller than a spacing between lug 70 of movable member 50 in the engagement position and hooked portion 40 of base 20. Second sliding grooves 60 provide rooms for movement of second pin 89 while movable member 50 is moving between the engagement position and disengagement position.

According to the form shown, each latch assembly 10 further includes a spring 72 including a first end 74 attached to lug 70 and a second end 76 attached to hooked portion 40, basing movable member 50 from the engagement position to the disengagement position.

According to the form shown, each latch assembly 10 further includes a follower 78 pivotably connected to movable member 50. Follower 78 includes two arms 85 spaced from each other along second axis Y and a connecting section 86 extending between arms 85. Each arm 85 has first and second ends 82 and 84. First pin 88 extends through first ends 82 of arms 85 of follower 78, allowing follower 78 to pivot about a pivot axis defined by first pin 88. Furthermore, follower 78 is movable together with first pin 88 in a length of each of first sliding grooves 58 and movement grooves 32 along first axis X.

According to the form shown, each latch assembly 10 further includes an actuation member 90 mounted in base 20 and having first and second ends 92 and 94 and a pivotal portion 96 between first and second ends 92 and 94. A third pin 91 extends through second engagement holes 30 of sidewalls 22 of base 20 and pivotal portion 96 of actuation member 90, allowing actuation member 90 to pivot about a pivot axis defined by third pin 91. First end 92 of actuation member 90 is located between arms 85 of follower 78. A push pin 98 is extended through second ends 84 of arms 85 of follower 78 and first end 92 of actuation member 90, allowing follower 78 and actuation member 90 to pivot about a pivot axis defined by push pin 98. Pivotal movement of actuation member 90 causes movement of follower 78 along first axis X.

According to the form shown, each latch assembly 10 further includes a limiting frame 101 fixed between sidewalls 22 of base 20 and having substantially U-shaped cross sections. Limiting frame 101 includes a first wall 103 and a second wall 113 spaced from first wall 103 along first axis X. Limiting frame 101 further includes a connecting wall 119 extending between first and second walls 103 and 113. First wall 103 includes an inner face 103A and an outer face 103B spaced from inner face 103A along first axis X. A slot 111 extends from inner face 103A through outer face 103B. A first engagement protrusion 115 is formed on a distal edge of each of first and second walls 103 and 113. Each of first and second walls 103 and 113 includes two lateral edges spaced along second axis Y. A second engagement protrusion 117 is formed on each lateral edge of second wall 113. Two wings 105 respectively extend from the lateral edges of first wall 103, with each wing 105 having a pivot hole 109.

In the form shown, each first engagement protrusion 115 of limiting frame 101 is engaged with one of first engagement grooves 42 of base 20. Each second engagement protrusion 117 of limiting frame 101 is engaged with one of second engagement grooves 44 of base 20. Thus, first and second walls 103 and 113 of limiting frame 101 are flush with the edges of slot 36. Pivot holes 109 of limiting frame 101 are aligned with second engagement holes 30 of base 20. Third pin 91 extends through pivot holes 109, second engagement holes 30, and pivotal potion 96 of actuation member 90, fixing limiting frame 101 between sidewalls 22 of base 20, with pivotal portion 96 of actuation member 90 located between wings 105, with second end 94 of actuation member 90 extending through slot 111 and received between first and second walls 103 and 113, with first end 92 of actuation member 90 located between first wall 103 of limiting frame 101 and movement grooves 32 of base 20 along first axis X.

According to the form shown, each latch assembly 10 further includes an actuation latch 131 movably received in slot 36 of base 20. Actuation latch 131 includes a base portion 132 having a first end 133 and a second end 137 spaced from first end 133 along third axis Z. Second end 137 of base portion 132 includes a first end portion 136 and a second end portion 136 spaced from first end portion 136 along second axis Y. A wedge 134 is formed on second end 137 and located between end portions 136. Wedge 134 includes substantially triangular cross sections and includes two actuating faces 135 meeting at an edge, with each actuating face 135 having an end intersecting with second end 137, and with actuating faces 135 located between end portions 136 along second axis Y. Actuation latch 131 is located between first and second walls 103 and 113 of limiting frame 101, with base portion 132 located between sidewalls 22 of base 20. A width between first and second end portions 136 along second axis Y is larger than a width of slot 36 of base 20 along second axis Y. Wedge 134 extends through slot 36 of base 20. Actuation latch 131 is movable along third axis Z between a releasing position in which wedge 134 extends out of base 20 (FIG. 5) and a pressing position in which wedge 134 is received in base 20 (FIG. 8). When actuation latch 131 is in the releasing position, second end 137 abuts the inner face of intermediate wall 38 of base 20.

According to the form shown, each latch assembly 10 further includes a locking block 139 mounted between lateral walls 52 of movable member 50. Locking block 139 includes a body 151 having a first surface 152 and a second surface 154 spaced from first surface 152 along first axis X. Locking block 139 further includes third and fourth surfaces 156 and 158 extending between first and second surfaces 152 and 154, with third and fourth surfaces 156 and 158 spaced from each other along third axis Z. A locking hole 153 in the form of a screw hole extends from first surface 152 through second surface 154. However, instead of a through-hole in the form shown, locking hole 153 can be defined in first surface 152 but spaced from second surface 154. A projection 155 is formed on third surface 156, and an engagement portion 157 is formed on fourth surface 158. Engagement portion 157 includes an engagement hole 159 extending along second axis Y. Locking hole 153 is located between projection 155 and engagement hole 159. Protrusion 155 is engaged in engagement slot 68 of movable member 50, with third surface 156 abutting an inner face of connecting portion 66, with engagement hole 159 of locking block 139 aligned with mounting holes 64 of lateral walls 52 of movable member 50. Locking block 139 is jointly movable with movable member 50 between the engagement position and the disengagement position along first axis X.

According to the form shown, latch assembly 10 further includes a restraining member 177 mounted in movable member 50. Restraining member 177 includes two sides 193 spaced from each other along second axis Y. Restraining member 177 further includes an limiting face 195 that is arcuate and extends between sides 193. Each side 193 includes a first end 179 and a second end 191 spaced from first end 179 along first axis X. Each side 193 further includes a slot 211 between first and second ends 179 and 191. A mounting hole 199 is defined in first end 179 of each side 193, with slot 211 located between second end 191 and mounting hole 199. A space 197 is defined between first ends 179 of sides 193 of restraining member 177 and spaced from slot 211. A protuberance 213 is formed on second end 191 of each side 193 of restraining member 177.

First ends 179 of sides 193 of restraining member 177 are engaged with locking block 139, with engagement portion 157 received in space 197, with engagement hole 159 aligned with mounting holes 199, with each protuberance 213 engaged in one of engagement notch 62 of movable member 50. Second pin 89 extends through first engagement holes 28 of base 20, second sliding grooves 60 of movable member 50 and slots 211 of restraining member 177. Second pin 89 moves in slots 211 while restraining member 177 and movable member 50 jointly move between the engagement position and the disengagement position.

Figure 3:
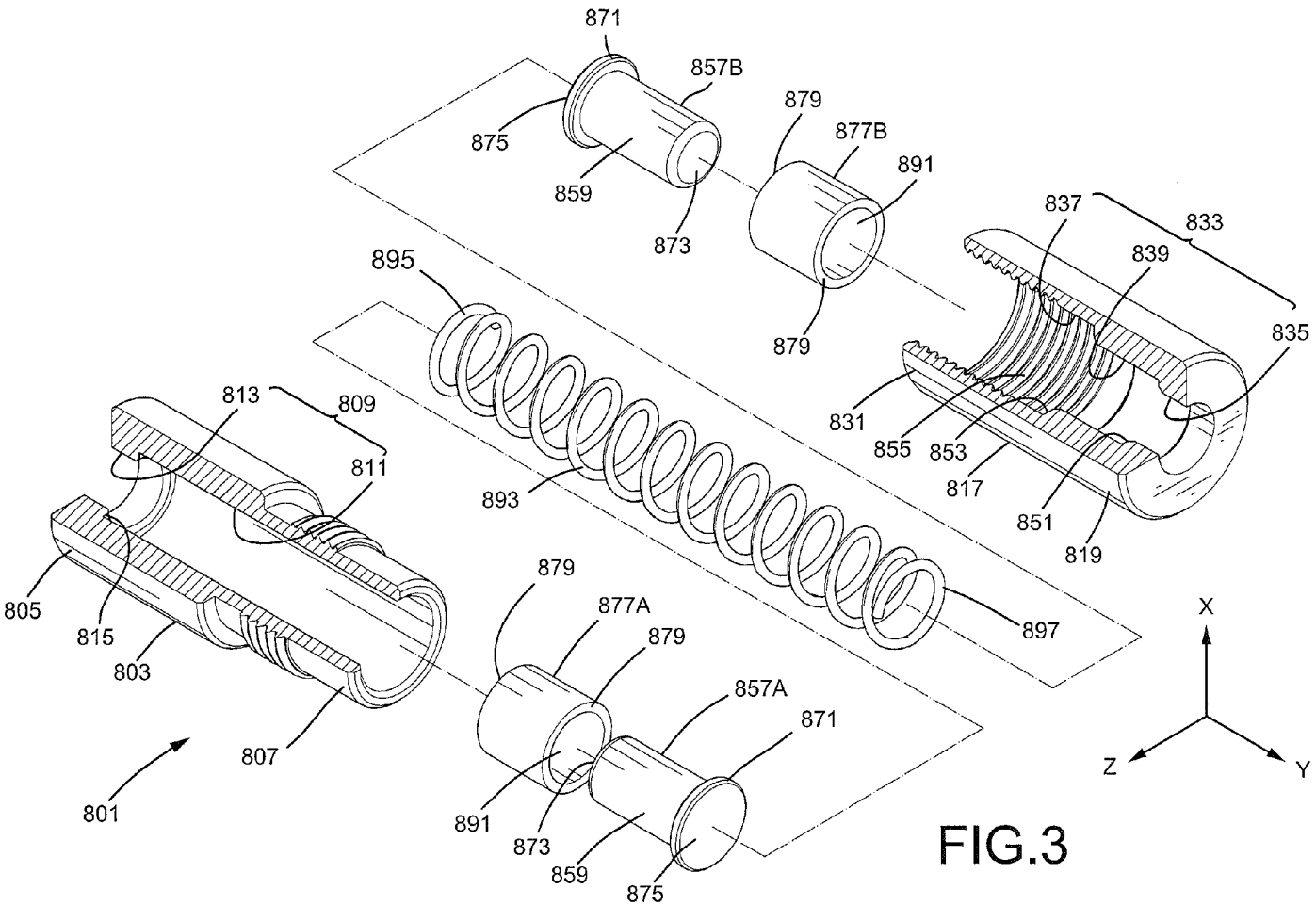
FIG. 3 shows an exploded, perspective view of a safety device of the latch assembly of FIG. 2.

According to the form shown, each latch assembly 10 further includes a safety device 801 (FIGS. 3 and 7) mounted to movable member 50 and restraining member 177. Safety device 801 includes first and second sleeves 803 and 817 engaged with each other. First sleeve 803 includes a first end 805 and a second end 807 spaced from first end 805 along second axis Y and having a diameter smaller than that of first end 805 and having an outer thread. A receiving hole 809 extends from first end 805 through second end 807. Receiving hole 809 includes a smaller section 813 extending from first end 805 towards but spaced from second end 807 and a larger section 811 extending from second end 807 through smaller section 813 and having a diameter larger than smaller section 813, with a shoulder 815 formed in an intersection of larger and smaller sections 811 and 813. Second sleeve 817 includes a first end 819 and a second end 831 spaced from first end 819 along second axis Y. A mounting hole 833 extends from first end 819 through second end 831. Mounting hole 833 includes a first hole section 835 extending from first end 819 towards but spaced from second end 831, a second hole section 837 extending from second end 831 towards but spaced from first end 819, and an intermediate hole section 839 between first and second hole sections 835 and 837, with a first abutment face 851 formed at an intersection of first hole section 835 and intermediate hole section 839, and with a second abutment face 853 formed at an intersection of intermediate hole section 839 and second hole section 837. Second hole section 837 includes an inner threading 855 spaced from second abutment face 853.

Figure 7:
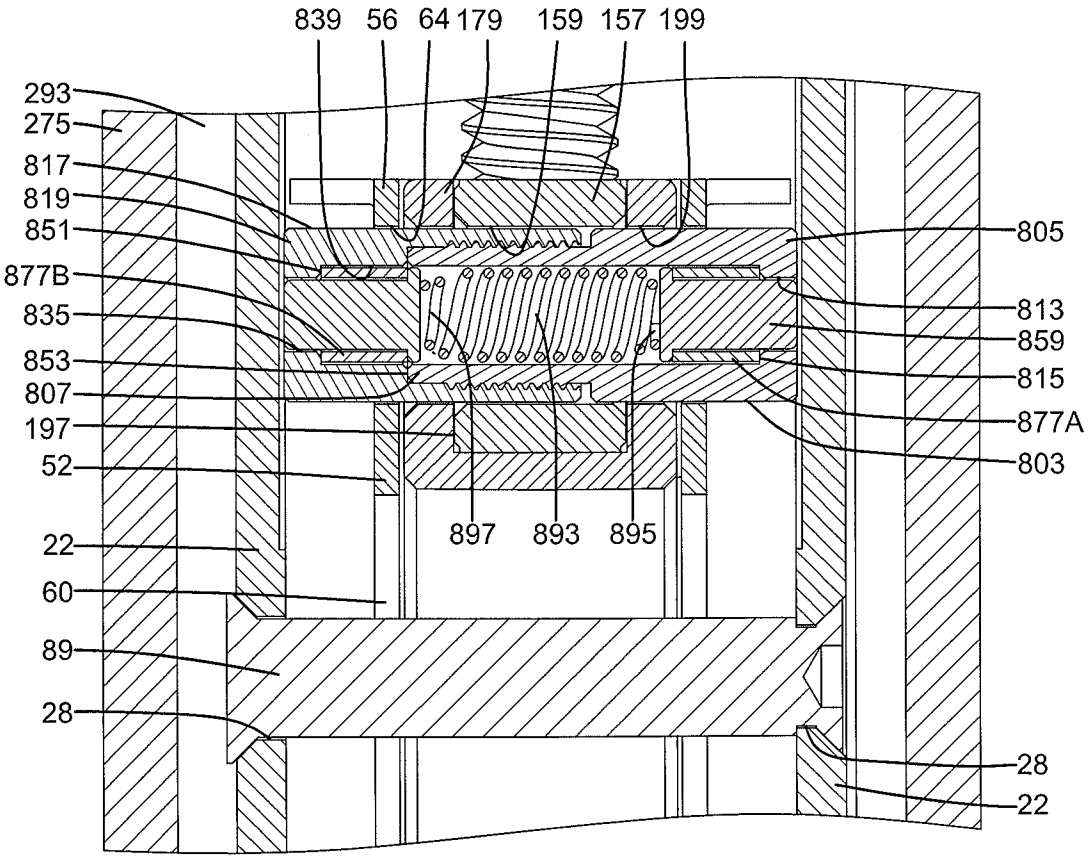
FIG. 7 shows a cross sectional view taken along section line 7-7 of FIG. 5.

Second end 807 of first sleeve 803 of safety device 801 is threaded into second hole section 837 of second sleeve 817 and engaged with inner threading 855. An end face of second end 807 of first sleeve 803 abuts second abutment face 853 of second sleeve 817 (FIG. 7).

According to the form shown, safety device 801 further includes first and second stops 877A and 877B respectively mounted in first and second sleeves 803 and 817. First and second stops 877A and 877B are made of a material having a melting point lower than first and second sleeves 803 and 817, such as plastic. Each of first and second stops 877A and 877B has two ends 879 and a through-hole 891 extending from an end 879 through the other end 879. First stop 877A has an outer diameter slightly smaller than the inner diameter of larger section 811 of first sleeve 803. First stop 877A is received in larger section 811 of first stop 877A, with an end 879 abutting shoulder 815. Second stop 877B has an outer diameter smaller than the inner diameter of intermediate hole section 839 of second sleeve 817. Second stop 877B is received in intermediate hole section 839 of second sleeve 817, with an end 879 abutting first abutment face 851. A length of second stop 877B along second axis Y is equal to a length of intermediate hole section 839 of second sleeve 817 along second axis Y.

According to the form shown, safety device 801 further includes first and second safety pins 857A and 857B respectively mounted in first and second sleeves 803 and 817. Each of first and second safety pins 857A and 857B has a cylindrical shank 859 and a flange 871 on an end of shank 859 and having an end face 875. Shank 859 further has a distal end 873 away from flange 871. The melting point of each of first and second safety pins 857A and 857B are higher than that of first and second stops 877A and 877B.

First safety pin 857A is mounted in receiving hole 809 of first sleeve 803, with shank 859 of first safety pin 857A extending through through-hole 891 of first stop 877A. A length of shank 859 along second axis Y is equal to a sum of a length of first stop 877A and a length of smaller section 813 of receiving hole 809 along second axis Y. An outer diameter of shank 859 of first safety pin 857A is slightly smaller than the inner diameter of smaller section 813 of receiving hole 809 of first sleeve 803 and slightly smaller than through-hole 891 of first stop 877A. An outer diameter of flange 871 of first safety pin 857A is slightly smaller than the inner diameter of larger section 811 of receiving hole 809 of first sleeve 803 but larger than the inner diameter of through-hole 891 of first stop 877A, such that flange 871 of first safety pin 857A abuts an end 879 of first stop 877A distant to shoulder 815. Furthermore, distal end 873 of shank 859 is extended through smaller section 813 of first sleeve 803, and an end face of distal end 873 of shank 859 of first safety pin 857A is flush with the end face of first end 805 of first sleeve 803.

Second safety pin 857B is mounted in mounting hole 833 of second sleeve 817. A length of shank 859 of second safety pin 857B along second axis Y is equal to the sum of a length of second stop 877B and a length of first hole section 835 of mounting hole 833 along second axis Y. An outer diameter of shank 859 of second safety pin 857B is slightly smaller than the inner diameter of first hole section 835 of mounting hole 833 of second sleeve 817 and slightly smaller than the inner diameter of through-hole 891 of second stop 877B. An outer diameter of flange 871 of second safety pin 857B is slightly smaller than the inner diameter of second hole section 837 of mounting hole 833 of second sleeve 817 but larger than the inner diameter of through-hole 891 of second stop 877B, such that flange 871 of second safety pin 857B abuts an end 879 of second stop 877B distant to first abutment face 851. Furthermore, distal end 873 of shank 859 of second safety pin 857B is extended through first hole section 835 of second sleeve 817, and an end face of distal end 873 of shank 859 of second safety pin 857B is flush with the end face of first end 819 of second sleeve 817.

Figure 9:
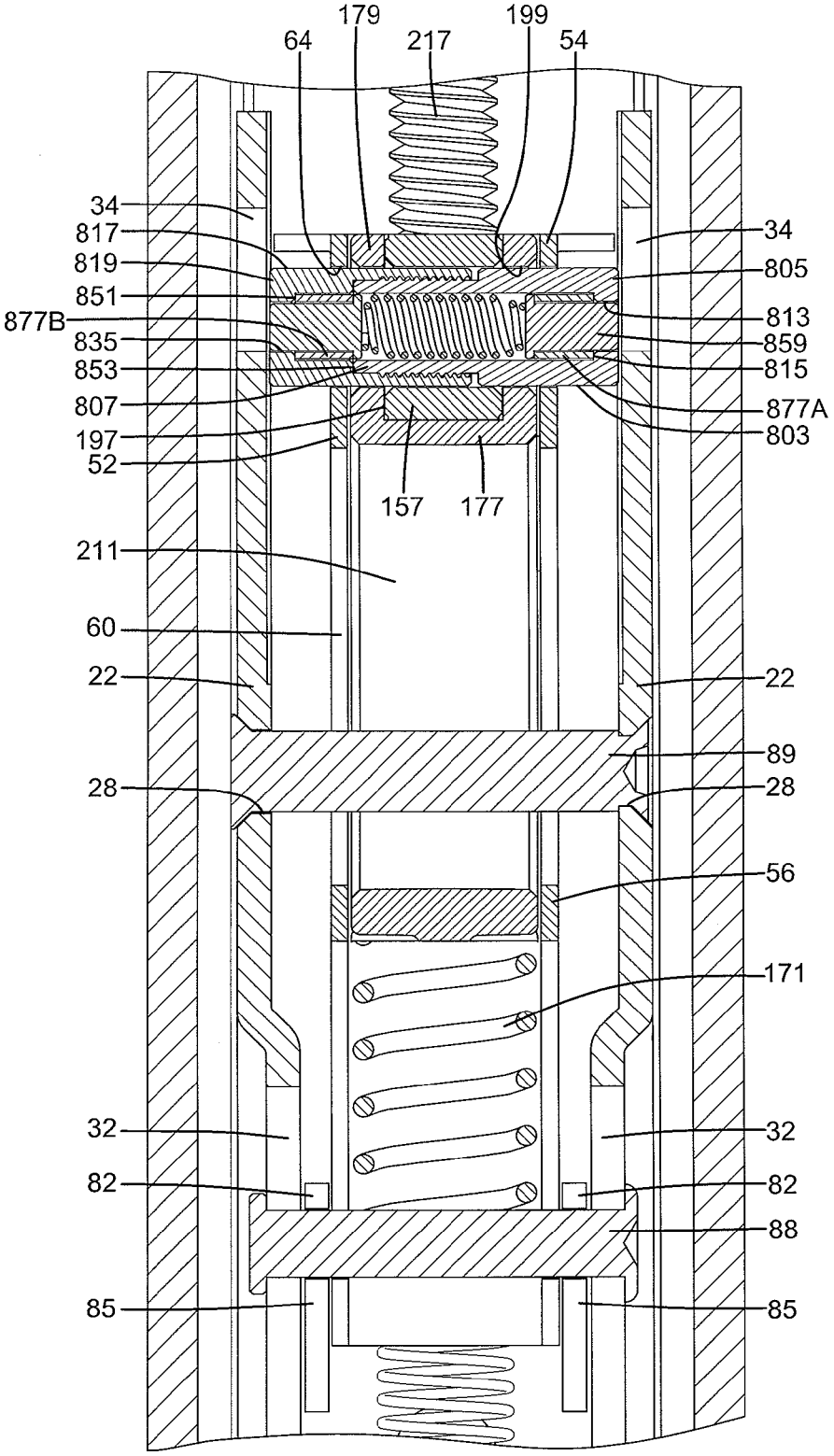
FIG. 9 shows across-sectional view taken along section line 9-9 of FIG. 8.
Figure 10:
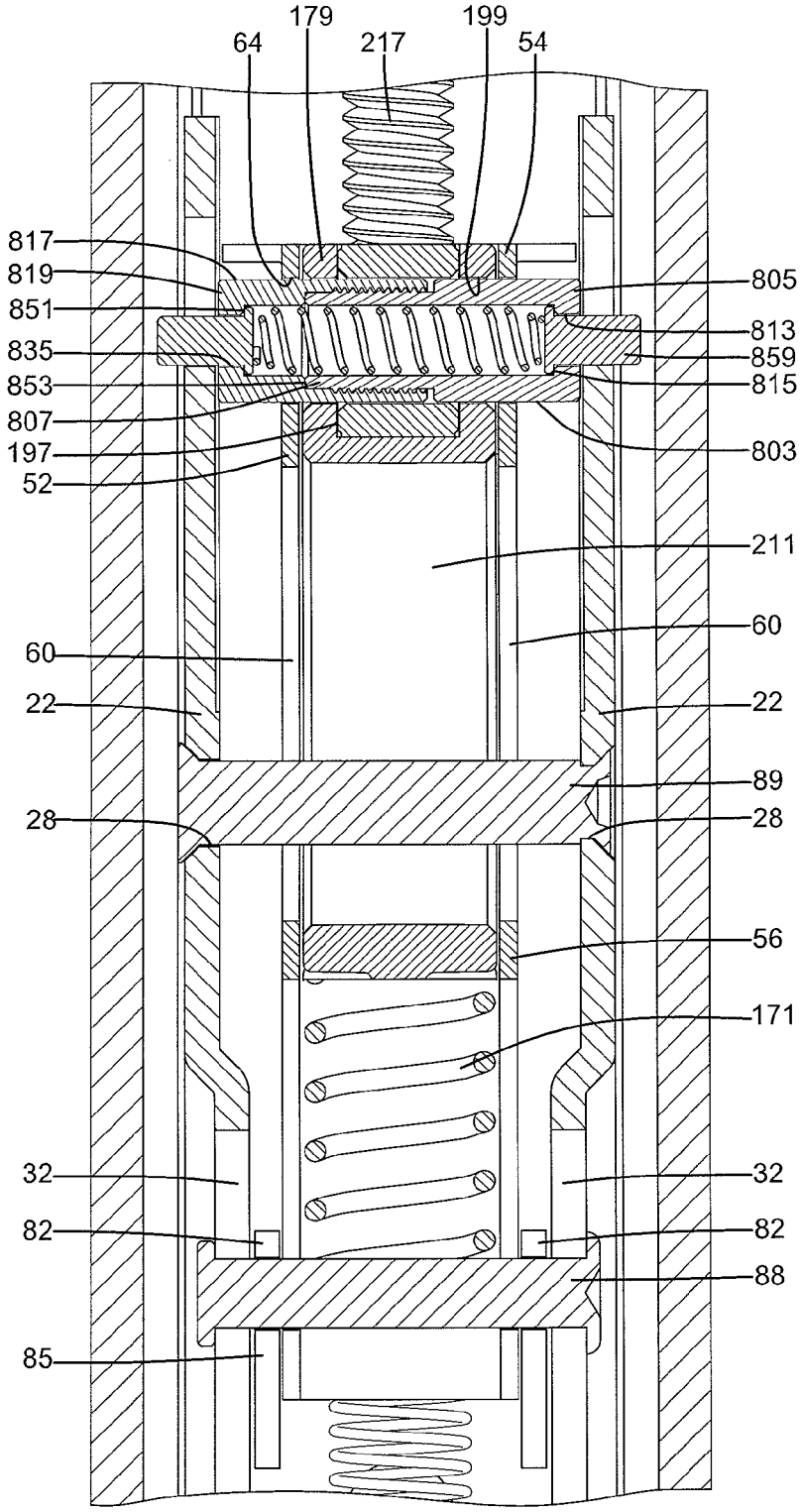
FIG. 10 shows a view similar to FIG. 9, with first and second safety pins of the safety device moved to an extended position during a fire.

According to the form shown, safety device 801 further includes a safety spring 893 mounted in larger section 811 of first sleeve 803 and having first and second ends 895 and 897. First end 895 of safety spring 893 presses against end face 875 of first safety pin 857A, and second end 897 of safety spring 893 presses against end face 875 of second safety pin 857B (FIG. 7). Thus, safety spring 893 biases first safety pin 857A towards one of sidewalls 22 of base 20 and biases second safety pin 857B towards the other sidewall 22 of base 20. However, first and second safety pins 857A and 857B are still stopped by first and second stops 877A and 877B, such that distal ends 873 of first and second safety pins 857A and 857B are in retracted positions in first and second sleeves 803 and 817 and, thus, can not extend beyond first and second sleeves 803 and 817 (FIGS. 7 and 9). Namely, movable member 50 can move along first axis X between the disengagement position (FIG. 5) and the engagement position (FIG. 8).

Safety device 801 is mounted in engagement hole 159 of locking block 139, with second end 831 of second sleeve 817 engaged in engagement hole 159 of locking block 139, with first end 805 of first sleeve 803 extends through one of mounting holes 199 of restraining member 177 and one of mounting holes 64 of movable member 50, with first end 819 of second sleeve 817 extending through the other mounting hole 199 of restraining member 177 and the other mounting hole 64 of movable member 50, and with safety device 801 located between sidewalls 22 of base 20. Movable member 50, locking block 139, and restraining member 177 are connected together by safety device 801 and jointly movable along first axis X between the disengagement position (FIG. 5) and the engagement position (FIG. 8).

According to the form shown, each latch assembly 10 further includes a spring 171 mounted between locking block 139 and first pin 88 and received in a space defined between lateral walls 52 of movable member 50 and located between connecting portion 66 of movable member 50 and limiting face 195 of restraining member 177. Spring 171 includes a first end 173 abutting against second surface 154 of locking block 139 and a second end 175 abutting against first pin 88. Spring 171 biases locking block 139 and first pin 88 away from each other along first axis X.

According to the form shown, each latch assembly 10 further includes a connecting rod 215 engaged with locking block 139. Specifically, connecting rod 215 includes a first end 217 having an outer threading engaged with locking hole 153 of locking block 139, allowing joint movement of connecting rod 215 and locking block 139. Connecting rod 215 further has a second end 219 to which a latch 231 is engaged. Latch 231 includes an engagement end 233 engaged with second end 219 of connecting rod 215 and a locking end 235. Latch 231 is jointly movable with connecting rod 215 along first axis X between a latching position and an unlatching position. When latch 231 is in the unlatching position (FIG. 5), locking end 235 is received in receiving holes 255. When latch 231 is in the latching position (FIG. 8), locking end 235 extends out of follower door 275.

Figure 5:
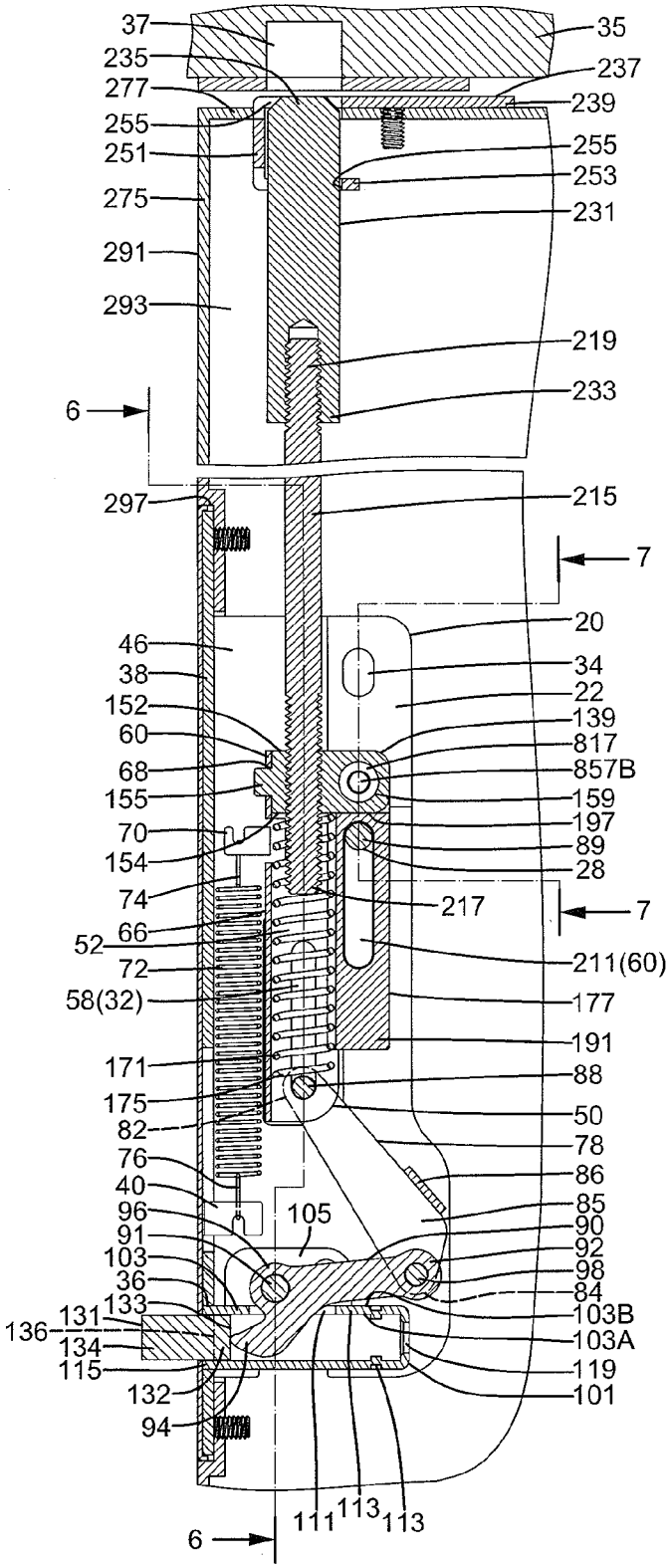
FIG. 5 shows a cross sectional view taken along section line 5-5 of FIG. 4.
Figure 6:
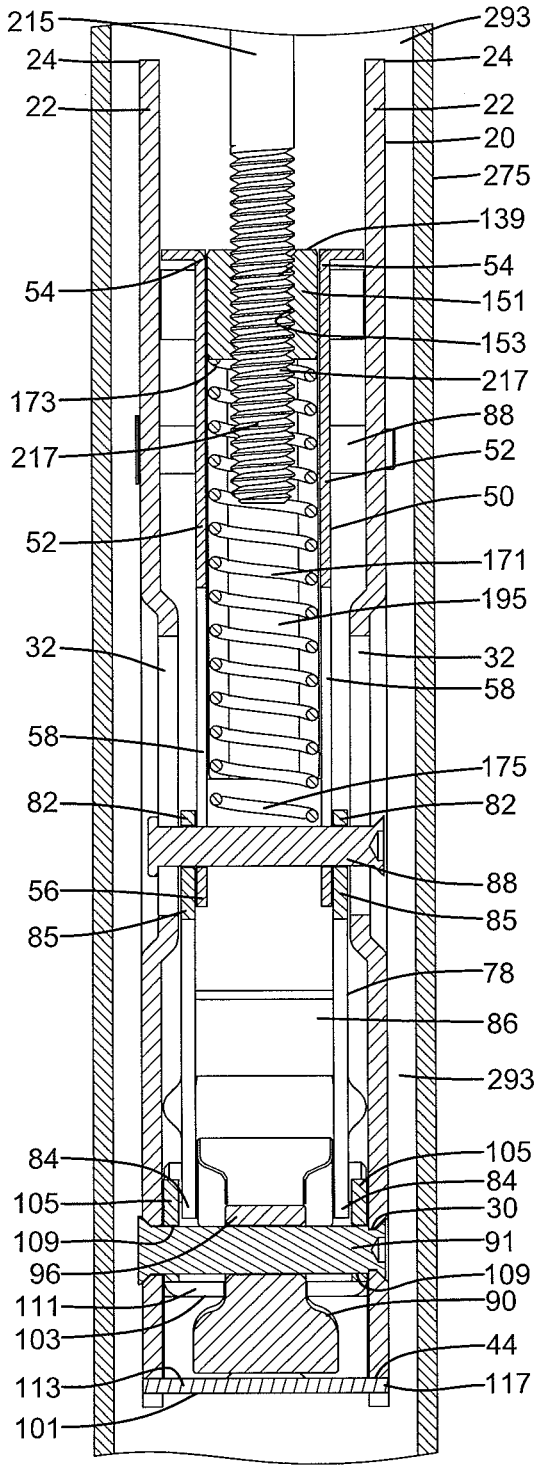
FIG. 6 shows a cross sectional view taken along section line 6-6 of FIG. 4.

Now that the basic construction of latch assemblies 10 has been explained, the operation and some of the advantages of latch assemblies 10 can be set forth and appreciated. In particular, for the sake of explanation, only the detailed operation of upper latch assembly 10 will be described, and it will be assumed that primary door 259 is in an open position and the follower door 275 is in the closed position (FIG. 5). Receiving holes 255 of upper coupling member 237 are aligned with groove 37 of top beam 35 of door frame 31. Note that receiving holes 255 of lower coupling member 237 are aligned with groove 300 in ground 299. End face 273 of primary door 259 is not aligned with end face 291 of follower door 275. Actuation latch 131 of each latch assembly 10 is not pressed and is in the releasing position (FIG. 5). Movable member 50 is in the disengagement position. Latch 231 is in the unlatching position.

When primary door 259 is moved to a closed position, end face 273 of primary door 259 is aligned with end face 291 of follower door 275, latch 333 is received in receptacle 294 of follower door 275, end face 273 of primary door 259 presses against one of actuating faces 135 of actuation latch 131, causing actuation latch 131 to move along third axis Z from the releasing position to the pressing position. First end 133 of actuation latch 131 presses against second end 94 of actuation member 90, causing pivotal movement of actuation member 90 about the pivot axis defined by third pin 91. First end 92 of actuation member 90 pushes push pin 98 and, thus, pushes first ends 82 of arms 85 of follower 78, causing pivotal movement of follower 78 about the pivot axis defined by push pin 98. First pin 88 received in movement grooves 32 of base 20 is pushed by first ends 82 of arms 85 of follower 78 to move along first axis X in a direction away from hooked portion 40. Thus, first pin 88 presses against second end 175 of spring 171, causing first end 173 of spring 171 to press against locking block 139, which, in turn, causes movement of movable member 50 via safety device 801. Thus, movable member 50, locking block 139, spring 171, safety device 801, and restraining member 177 move jointly from the disengagement position (FIG. 5) to the disengagement position (FIG. 8).

While movable member 50 is moving from the disengagement position to the engagement position, first end 74 of spring 72 is pulled by lug 70 of movable member 50. Locking block 139 causes movement of latch 231 from the unlatching position (FIG. 5) to the latching position (FIG. 8) via connecting rod 215. Thus, locking end 235 of latch 231 is engaged in groove 37 in top beam 35. Note that locking end 235 of latch 231 of lower latch assembly 10 is engaged in groove 300 in ground 299. As a result, follower door 275 can not pivot from the closed position to the open position relative to door frame 31. Furthermore, primary door 259 can not be opened either, because latch 333 of door lock 319 on primary door 259 is engaged in receptacle 294 of follower door 275.

If handle 331 is operated to retract latch 333 from receptacle 294, primary door 259 can be opened to disengage end face 273 of primary door 259 from actuation latch 131. Spring 72 pulls movable member 50 from the engagement position to the disengagement position, and actuating latch 131 moves from the pressing position to the releasing position. Latch 231 is moved from the latching position to the unlatching position, disengaging locking end 235 from groove 37 of top beam 35. Note that latch 231 of lower latch assembly 10 is also moved from the latching position to the unlatching position, disengaging locking end 235 from groove 300 in ground 299. Thus, follower door 275 can be moved to the open position.

When latch 231 is in the latching position, first and second safety pins 857A and 857B of safety device 801 are aligned with coupling holes 34 of base 20. In a case that a fire occurs while both of follower door 275 and primary door 259 are in their closed positions, first and second stops 877A and 877B made of plastic melt due to the heat of the fire. First safety pin 857A is moved from the retracted position to an extended position into one of coupling holes 34 of base 20 under the action of safety spring 893. Likewise, second safety pin 857B is moved from the retracted position to an extended position into the other coupling hole 34 of base 20 under the action of safety spring 893. Thus, movable member 50 is retained in the engagement position, retaining latch 231 in the latching position. Thus, primary door 259 can not be opened during the fire even if latch 333 of door lock 319 is retracted, avoiding spread of the fire by avoiding opening of double door 257.

Figure 11:
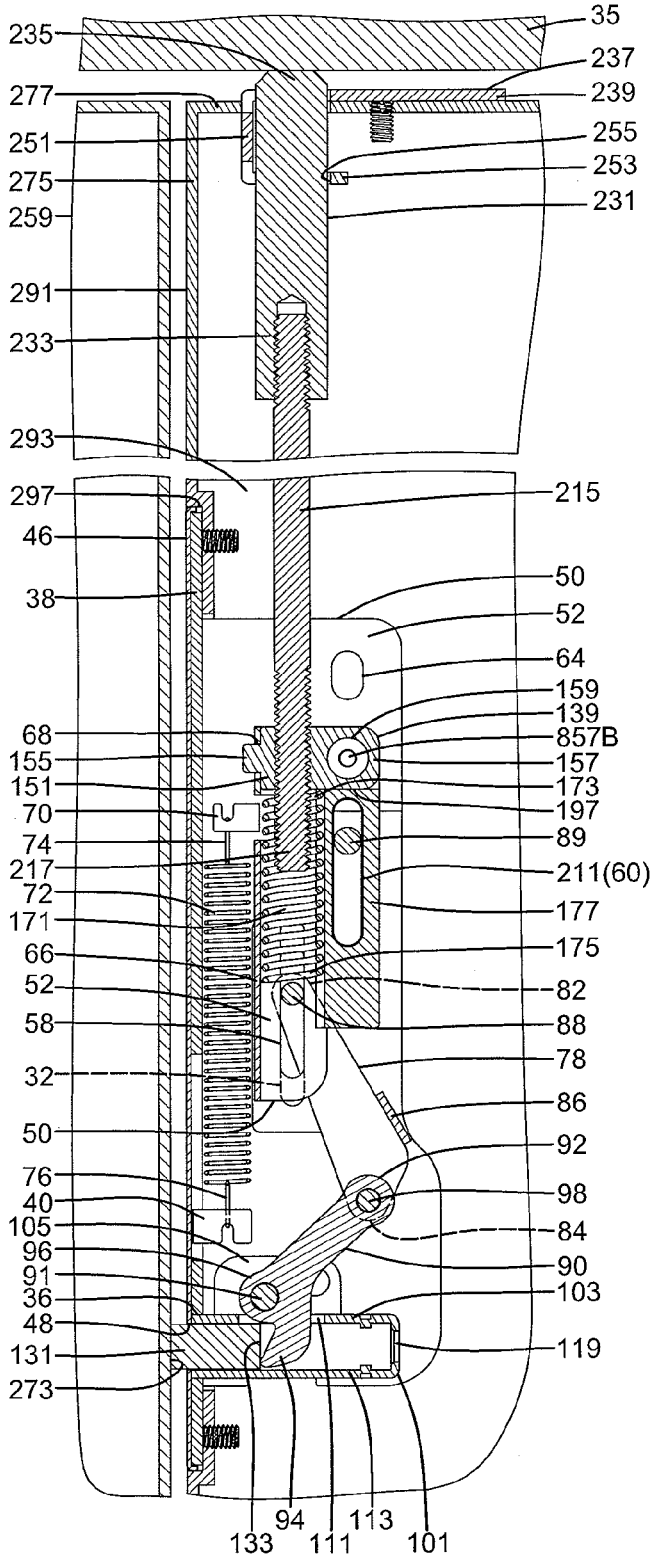
FIG. 11 shows a view similar to FIG. 5, with the latch not aligned with the groove of the door frame, and with the primary door moved to a closed position.

With reference to FIG. 11, in a case that follower door 275 is not exactly in the closed position (i.e., receiving holes 255 of upper coupling member 237 are not aligned with groove 37 in top beam 35, and receiving holes 255 of lower coupling member 237 are not aligned with groove 300 in ground 299), if primary door 259 is moved to the closed position, actuation latch 131 is moved to the pressing position, movement of latch 231 from the unlatching position to the latching position is hindered by top beam 35 (and movement of latch 231 of lower latch assembly 10 from the unlatching position to the latching position is hindered by ground 299). Thus, movable member 50 is retained in the disengagement position, and locking block 139, restraining member 177, spring 171, and safety device 801 are not moved. However, first pin 88 moves along first axis X in the direction away from hooked portion 40 and compresses spring 171, causing actuation member 90 to pivot about the pivot axis defined by third pin 91 and causing follower 78 to pivot about the pivot axis defined by push pin 98 without driving latch 231 to the latching position. This avoids damage to latch assembly 10 resulting from improper operation.

Each latch assembly 10 can automatically move latch 231 to the latching position while primary door 259 is moved to the closed position. Furthermore, even if actuation latch 131 of each latch assembly 10 is actuated by primary door 259 while latches 231 are not aligned with grooves 37 and 300, only actuation member 90 and follower 78 are pivoted to cause first pin 88 to compress spring 171. Latch 231, movable member 50, locking block 139, and restraining member 177 are not moved, effectively protecting latch assembly 10 from improper operation. Furthermore, since latch 231 is operatively connected to actuation latch 131, if latch 231 is picked with an intention to move actuation latch 131, movement of actuation latch 131 from the pressing position to the releasing position is hindered by primary door 259, providing an anti-pick function. Furthermore, first and second safety pins 857A and 867B of safety device 801 extend into coupling holes 34 of base 20 when a fire occurs, reliably retain latch 231 in the latching position to avoid spread of the fire by avoid opening of double door 257.

Now that the basic teachings of the present invention have been explained, many extensions and variations will be obvious to one having ordinary skill in the art. For example, each latch assembly 10 does not have to include safety device 801 when it is not necessary to retain latch 231 in the latching position during a fire. Locking block 139 can be fixed by screws through lateral walls 52 of movable member 50 into body 151 of locking block 139. Furthermore, each latch assembly 10 does not have to include restraining member 177. In this case, lateral walls 52 of movable member 50 can have L-shaped cross sections, with spring 171 located between connecting portion 66 and L-shaped lateral walls 52, avoiding distortion of compressed spring 171. Furthermore, each latch assembly 10 does not have to include coupling member 237. In this case, follower door 275 includes a hole through which latch 231 passes to engage with groove 37 or 300. Further, follower 78 can include only one arm 85.

Furthermore, only one latch assembly 10 is sufficient to lock double door 257. In a case that only upper latch assembly 10 is utilized, since the downward moving direction of latch 231 along first axis X from the latching position to the unlatching position is the same as the acting direction of the gravitational force, upper latch assembly 10 does not have to include spring 72, and latch 231 is biased by the gravitational force from the latching position to the unlatching position.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A latch assembly comprising:

a base (20) including two sidewalls (22) and an intermediate wall (38) extending between the two sidewalls (22), with each of the two sidewalls (22) including a movement groove (32) and first and second engagement holes (28, 30), with the movement groove (32) located between the first engagement hole (28) and the second engagement hole (30) along a first axis (X), with the intermediate wall (38) including a slot (36), with the intermediate wall (38) of the base (20) adapted to be mounted to an end face (291) of a follower door (275) of a double door (257), with the follower door (275) including an interior space (293), with the two sidewalls (22) adapted to be received in the interior space (293) of the follower door (275), with the follower door (275) pivotable between a closed position and an open position;

a movable member (50) movably received between the two sidewalls (22) of the base (20), with the movable member (50) including two lateral walls (52) spaced from each other along a second axis (Y) perpendicular to the first axis (X), with the movable member (50) further including a connecting portion (66) extending between the two lateral walls (52), with each of the two lateral walls (52) including a first end (54) and a second end (56) spaced from the first end (54) along the first axis (X), with first and second sliding grooves (58, 60) defined in each of the two lateral walls (52), with the first sliding groove (58) located between the second sliding groove (60) and the connecting portion (66) along a third axis (Z) perpendicular to the first and second axes (X,Y), with the movement grooves (32) of the two sidewalls (22) of the base (20) aligned with the first sliding grooves (58) of the two lateral walls (52) of the movable member (50);

a first pin (88) extending through the movement grooves (32) of the two sidewalls (22) of the base (20) and the first sliding grooves (58) of the two lateral walls (52) of the movable member (50);

a second pin (89) extending through the first engagement holes (28) of the two sidewalls (22) of the base (20) and the second sliding grooves (60) of the two lateral walls (52) of the movable member (50), with the movable member (50) movable between an engagement position and a disengagement position along the first axis (X), a follower (78) pivotably connected to the movable member (50), with the follower (78) including an arm (85) having first and second ends (82, 84), with the first pin (88) extending through the first end (82) of the arm (85), allowing the follower (78) to pivot about a pivot axis defined by the first pin (88);

an actuation member (90) pivotably received in the base (20) and having first and second ends (92, 94) and a pivotal portion (96) between the first and second ends (92, 94) of the actuation member (90), with the second end (94) of the actuation member (90) facing the intermediate wall (38) of the base (20);

a third pin (91) extending through the second engagement holes (30) of the two sidewalls (22) of the base (20) and the pivotal portion (96) of the limiting member (90), with the limiting member (90) pivotable about a pivot axis defined by the third pin (91);

a limiting frame (101) fixed between the two sidewalls (22) of the base (20), with the limiting frame (101) including a first wall (103) and a second wall (113) spaced from the first wall (103) along the first axis (X), with the limiting frame (101) further including a connecting wall (119) extending between the first and second walls (103, 113), with the first wall (103) including an inner face (103A) and an outer face (103B) spaced from the inner face (103A) along the first axis (X), with a slot (111) extending from the inner face (103A) through the outer face (103B) of the first wall (103), with the first and second walls (103, 113) fixed to the intermediate wall (38) of the base (20), with the second end (94) of the actuation member (90) extending through the slot (111) and received between the first and second walls (103, 113);

an actuation latch (131) movably received in the slot (36) of the base (20), with the actuation latch (131) including a base portion (132) having first and second ends (133, 137) spaced from each other along the third axis (Z), with a wedge (134) formed on the second end (137) of the actuation latch (131) and having two actuation faces (135), with the actuation latch (131) movable along the third axis (Z) between a releasing position in which the wedge (134) is located outside of the base (20) and a pressing position in which the wedge (134) is received in the base (20), with the actuation latch (131) adapted to be actuated by an end face (273) of a primary door (259) of the double door (257), wherein when the follower door (275) is in the closed position and when the end face (273) of the primary door (259) is aligned with the end face (291) of the follower door (275), the end face (273) of the primary door (259) presses against the actuation latch (131), moving the actuation latch (131) from the releasing position to the pressing position;

a locking block (139) fixed to the movable member (50), with the locking block (139) including a locking hole (153), with the locking block (139) and the movable member (50) jointly movable between the engagement position and the disengagement position;

a first spring (171) mounted between the locking block (139) and the first pin (88), with the first spring (171) biasing the locking block (139) and the first pin (88) away from each other along the first axis (X);

a connecting rod (215) including a first end (217) engaged in the locking hole (153) of the locking block (139) and a second end (219);

a latch (231) including an engagement end (233) fixed to the second end (219) of the connecting rod (215), with the latch (231) further including a locking end (235), with the latch (231) movable between a latching position and an unlatching position along the first axis (X), with the locking end (235) of the latch (231) in the unlatching position being adapted to be received in the follower door (275), with the locking end (235) of the latch (231) in the latching position adapted to extend out of the follower door (275) into a groove (37) in a door frame (31) or a groove (300) in a ground (299), with the double door (257) adapted to be pivotably mounted to the door frame (31);

wherein when the follower door (275) is in the open position, the latch (231) is not aligned with the groove (37, 300) in the door frame (31) or ground (299), when the follower door (275) is in the closed position, the latch (231) is aligned with the groove (37, 300) in the door frame (31) or ground (299), wherein when the actuation latch (131) is in the releasing position, the movable member (50) is in the disengagement position, and the latch (231) is in the unlatching position, wherein when the follower door (275) is in the closed position and when the actuation latch (131) moves from the releasing position to the pressing position, the first end (133) of the actuation latch (131) pushes the second end (94) of the actuation member (90) to move the second end (84) of the follower (78), causing the first pin (88) to push the locking block (139) via the first spring (171), moving the movable member (50) from the disengagement position to the engagement position while pulling the first spring (171), thereby moving the locking end (235) of the latch (231) to the latching position to engage with the groove (37, 300) in the door frame (31) or ground (299), wherein when the actuation latch (131) is moved from the releasing position to the pressing position while the follower door (275) is not in the closed position, the actuation member (90) actuates the follower (78) via the push pin (98), moving the first pin (88) in the movement grooves (32) of the base (20) along the first axis (X) and compressing the first spring (171), retaining the movable member (50) in the disengagement position and retaining the latch (231) in the unlatching position, avoiding damage to the latch assembly.

2. The latch assembly as claimed in claim 1, with the intermediate wall (38) of the base (20) further including a hooked portion (40) located between the movement groove (32) of each of the two sidewalls (22) of the base (20) and the slot (36) of the intermediate wall (38) along the first axis (X), with the connecting portion (66) of the movable member (50) further including a lug (70), with a second spring (72) mounted between the lug (70) and the hooked portion (40), with the second spring (72) biasing the movable member (50) from the engagement position to the disengagement position, with a spacing between the lug (70) of the movable member (50) in the disengagement position and the hooked portion (40) being smaller than a spacing between the lug (70) of the movable member (50) in the engagement position and hooked portion (40).

3. The latch assembly as claimed in claim 1, with the connecting portion (66) of the movable member (50) including an engagement slot (68), with the lug (70) located between the engagement slot (68) and the first sliding groove (58) of each of the two lateral walls (52) of the movable member (50) along the first axis (X), with the locking block (139) including a projection (155) engaged in the engagement slot (68) to allow joint movement of the locking block (139) and the movable member (50) between the engagement position and the disengagement position.

4. The latch assembly as claimed in claim 3, further comprising:

a restraining member (177) mounted in the movable member (50), with the restraining member (177) including two sides (193) spaced from each other along the second axis (Y) and a limiting face (195) extending between the two sides (193), with each of the two sides (193) including a slot (211) aligned with the second sliding grooves (60) of the movable member (50), with the second pin (89) extending through the slots (211) of the restraining member (177) and the second sliding grooves (60) of the movable member (50), with the first spring (171) located between the connecting portion (66) and the limiting face (195).

5. The latch assembly as claimed in claim 4, with each of the two sidewalls (22) of the base (20) further including a coupling hole (34), with the first engagement hole (28) located between the coupling hole (34) and the movement groove (32), with each of the two lateral walls (52) of the movable member (50) further including a mounting hole (64), with the locking block (139) further including an engagement portion (157) having an engagement hole (159) extending along the second axis (Y), with the locking hole (153) located between the projection (155) and the engagement hole (159), with the engagement hole (159) of the restraining member (177) aligned with the mounting holes (64) of the two lateral walls (52) of the movable member (50), with each of the two sides (193) of the restraining member (177) including first and second ends (179, 191) spaced from each other along the first axis (X), with a mounting hole (199) defined in the first end (179) of each of the two sides (193) of the restraining member (177), with a space (197) defined between the first ends (179) of the two sides (193) of the restraining member (177), with the latch assembly further comprising:

a first sleeve (803) including first and second ends (805, 807) spaced along the second axis (Y), with a receiving hole (809) extending from the first end (805) through the second end (807) of the first sleeve (803), with the receiving hole (809) including a smaller section (813) extending from the first end (805) towards but spaced from through the second end (807) of the first sleeve (803) and a larger section (811) extending from the second end (807) through the smaller section (813) and having a diameter larger than the smaller section (813), with the first end (805) of the first sleeve (803) extending through the mounting hole (64) of one of the two lateral walls (52) of the movable member (50) and the mounting hole (199) of one of the two sides (193) of the restraining member (177);

a second sleeve (817) including first and second ends (819, 831) spaced along the second axis (Y), with a mounting hole (833) extending from the first end (819) through the second end (831) of the second sleeve (817), with the mounting hole (833) including a first hole section (835) extending through the first end (819) of the second sleeve (817), with the mounting hole (833) further including a second hole section (837) extending through the second end (831) of the second sleeve (817), with the second end (831) of the second sleeve (817) engaged with the second end (807) of the first sleeve (803), with the first end (819) of the second sleeve (817) extending through the mounting hole (64) of another of the two lateral walls (52) of the movable member (50) and the mounting hole (199) of another of the two sides (193) of the restraining member (177), with the first ends (805) of the first and second sleeves (803, 817) located between the two sidewalls (22) of the base (20);

a first stop (877A) having a melting point lower than the first and second sleeves (803, 817), with the first stop (877A) received in the larger section (811) of the receiving hole (809) of the first sleeve (803);

a second stop (877B) having a melting point lower than the first and second sleeves (803, 817), with the second stop (877B) received in the mounting hole (833) of the second sleeve (817);

a first safety pin (857A) received in the receiving hole (809) of the first sleeve (803), with the first safety pin (857A) including a first shank (859) having a first distal end (873), with the first safety pin (857A) further including a first flange (871) formed on an end of the first shank (859) opposite to the first distal end (873) and having a diameter larger than a diameter of the first shank (859), with the first shank (859) of the first safety pin (857A) extending through the first stop (877A) into the smaller section (813) but not extending beyond the first end (805) of the first sleeve (803), with the first stop (877A) located between the first flange (871) of the first safety pin (857A) and the smaller section (813) of the first sleeve (803);

a second safety pin (857B) received in the mounting hole (833) of the second sleeve (817), with the second safety pin (857B) including a second shank (859) having a second distal end (873), with the second safety pin (857B) further including a second flange (871) formed on an end of the second shank (859) opposite to the second distal end (873) and having a diameter larger than a diameter of the second shank (859), with the second shank (859) of the second safety pin (857B) extending through the second stop (877B) into the first hole section (835) but not extending beyond the first end (819) of the second sleeve (817), with the second stop (877B) located between the second flange (871) of the second safety pin (857B) and the first hole section (835) of the second sleeve (817);

a safety spring (893) mounted in the larger section (811) of the receiving hole (809) of the first sleeve (803), with the safety spring (893) including a first end (895) pressing against the first flange (871) of the first safety pin (857A) and a second end (897) pressing against the second flange (871) of the second safety pin (857B), with the safety spring (893) biasing the first and second safety pins (857A, 857B) towards the two sidewalls (22) of the base (20), with the first and second safety pins (857A, 857B) being aligned with the coupling holes (34) of the two sidewalls (22) of the base (20) when the latch (231) is in the latching position, with the latch (231) in the latching position and with the first and second stops (877A, 877B) melted by heat, the safety spring (893) moves the first distal end (873) of the first safety pin (857A) and the second distal end (873) of the second safety pin (857B) into the coupling holes (34) of the two sidewall (22) of the base (20), retaining the movable member (50) in the engagement position to retain the latch (231) in the latching position.

* * * * *